US011168936B2

(12) United States Patent
Bento et al.

(10) Patent No.: US 11,168,936 B2
(45) Date of Patent: Nov. 9, 2021

(54) STORAGE BIN ASSEMBLY FOR A REFRIGERATOR

(71) Applicant: WHIRLPOOL CORPORATION, Benton Harbor, MI (US)

(72) Inventors: Edson Isaltino Bento, Santa Catarina (BR); Guilherme Nehring, Santa Catarina (BR); Luiz Alfranio Alves Ferreira, Santa Catarina (BR)

(73) Assignee: Whirlpool Corporation, Benton Harbor, MI (US)

( * ) Notice: Subject to any disclaimer, the term of this patent is extended or adjusted under 35 U.S.C. 154(b) by 286 days.

(21) Appl. No.: 16/047,560

(22) Filed: Jul. 27, 2018

(65) Prior Publication Data

US 2019/0041122 A1 Feb. 7, 2019

Related U.S. Application Data

(60) Provisional application No. 62/539,842, filed on Aug. 1, 2017.

(51) Int. Cl.

| | |
|---|---|
| ***F25D 25/02*** | (2006.01) |
| ***F25D 23/04*** | (2006.01) |
| ***A47B 88/60*** | (2017.01) |
| ***F25D 25/00*** | (2006.01) |
| ***F25D 23/06*** | (2006.01) |

(52) U.S. Cl.

CPC ..... *F25D 25/021* (2013.01); *A47B 88/60* (2017.01); *F25D 23/04* (2013.01); *F25D 23/062* (2013.01); *F25D 25/005* (2013.01)

(58) Field of Classification Search

CPC ..... F25D 25/021; F25D 25/005; F25D 25/02; F25D 23/062; F25D 23/04; F25D 23/08; F25D 23/10; F25D 23/125; F25D 2325/00; F25D 23/065; F25D 23/067; F25D 10/123; F25D 2323/022; A47B 88/60

USPC ..... 312/401, 405, 405.1, 321.5

See application file for complete search history.

(56) References Cited

U.S. PATENT DOCUMENTS

| | | | | |
|---|---|---|---|---|
| 4,798,425 A * | 1/1989 | Armstrong | F25D 23/04 | 312/138.1 |
| 5,193,892 A * | 3/1993 | Swindell | F25D 23/025 | 312/274 |
| 5,445,452 A * | 8/1995 | Kauffman | F25D 23/04 | 312/321.5 |
| 5,765,390 A * | 6/1998 | Johnson | A47F 5/005 | 211/43 |
| 6,074,030 A * | 6/2000 | Prunty | E05F 5/02 | 16/374 |
| 6,782,710 B2 * | 8/2004 | Eveland | F25D 11/02 | 312/404 |

(Continued)

*Primary Examiner* — Emmanuel E Duke
(74) *Attorney, Agent, or Firm* — Price Heneveld LLP

(57) ABSTRACT

A storage compartment for a refrigerator includes a base portion and first and second sidewalls spaced-apart from one another and upwardly extending from the base portion. A support member interconnects the inner and outer sidewalls. A door is pivotally coupled to the first and second sidewalls between open and closed positions, wherein the door further includes one or more inwardly extending retaining struts having upwardly extending tabs. The upwardly extending tabs abut an undersurface of the interconnecting support member when the door is in the closed position.

12 Claims, 6 Drawing Sheets

(56) References Cited

U.S. PATENT DOCUMENTS

| | | | | |
|---|---|---|---|---|
| 6,983,615 | B2 * | 1/2006 | Winders | F25D 23/04 62/115 |
| 7,309,116 | B2 * | 12/2007 | Garrett | F25D 23/04 312/405.1 |
| 7,350,886 | B2 * | 4/2008 | Antos | A47B 46/00 312/404 |
| 7,472,974 | B2 | 1/2009 | Czach et al. | |
| 8,590,993 | B2 * | 11/2013 | Lee | F25D 25/025 312/404 |
| 8,757,458 | B2 * | 6/2014 | Nebel | B60R 11/06 224/403 |
| 9,127,878 | B2 * | 9/2015 | Gossens | F25D 25/025 |
| 2008/0203876 | A1 * | 8/2008 | Lim | A47B 96/02 312/405 |
| 2010/0219731 | A1 * | 9/2010 | Candeo | F25D 25/025 312/404 |
| 2010/0257892 | A1 * | 10/2010 | Lee | F25D 23/04 62/449 |
| 2013/0026900 | A1 * | 1/2013 | Oh | F25D 25/027 312/401 |
| 2016/0131415 | A1 | 5/2016 | Shrader et al. | |

* cited by examiner

STORAGE BIN ASSEMBLY FOR A REFRIGERATOR

CROSS-REFERENCE TO RELATED APPLICATION(S)

This application claims priority to and the benefit under 35 U.S.C. § 119(e) of U.S. Provisional Patent Application No. 62/539,842, filed on Aug. 1, 2018, entitled STORAGE BIN ASSEMBLY FOR REFRIGERATOR, the entire disclosure of which is hereby incorporated herein by reference.

BACKGROUND

The present concept generally relates to a storage bin assembly for a refrigerator. More particularly, the storage bin assembly includes multiple compartments that may be opened or closed and is configured to couple to and be supported by a door of the refrigerator.

Refrigerators may be provided with several different compartments, and some of these compartments can be supported from a door of the refrigerator. Refrigerator door bins are generally known and can include a bin unit configured for removable assembly with a liner of the refrigerator door. The configuration of the bin unit separate from the liner is generally a product of the material and process limitations associated with the liner, which is usually formed using a vacuum-forming process. The bin unit is generally more suitable for an injection molding or similar process. Accordingly, the bin unit and liner are often separately made and must be assembled together. Most assemblies facilitate selective placement of the bin within a number of available positions on a refrigerator door. Such known assemblies may provide weak attachment between the bin unit and the associated liner of the door, requiring additional fixation (such as the taping of adjacent components) during shipping. Beyond transportation and assembly issues, it is desired to provide a storage bin having a closeable compartment while still providing for sufficient lighting and visibility of storage space defined by the compartment.

SUMMARY

In at least one aspect, a refrigerator includes a door having a liner disposed on an inner portion of the door. The liner includes opposed outwardly extending sidewalls that are spaced-apart from one another. Outwardly extending coupling features are disposed on inner surfaces of each opposed sidewall. A storage bin assembly includes one or more storage compartments positioned on a base portion and opposed outer sidewalls upwardly extending from the base portion. In coupling the storage bin assembly to the liner of the door, outwardly extending coupling features of the opposed outwardly extending sidewalls of the liner are removeably received in receiving apertures disposed through the opposed outer sidewalls of the storage bin assembly.

In another aspect, a storage compartment for a refrigerator includes a base portion and first and second sidewalls spaced-apart from one another and upwardly extending from the base portion. A support member interconnects the inner and outer sidewalls. A door is pivotally coupled to the first and second sidewalls between open and closed positions. The door further includes at least one inwardly extending retaining strut that abuts an undersurface of the interconnecting support member when the door is in the closed position.

In another aspect, a storage compartment for a refrigerator includes a frame assembly defining an inner cavity and having a front aperture opening into the inner cavity. A door is pivotally coupled to the frame assembly at pivot locations disposed within the inner cavity. The door further includes a retaining strut disposed on an inner surface of the door that abuts an interior surface of the frame assembly at an upper portion of the retaining strut within the inner cavity when the door is in a closed position.

In another aspect, a refrigerator includes a door having an inner surface with outwardly extending first and second sidewalls spaced-apart from one another, wherein the first and second sidewalls each include opposed inner surfaces having outwardly extending coupling features. A storage bin assembly includes a base portion with opposed first and second outer sidewalls upwardly extending from the base portion. The first and second outer sidewalls of the storage bin assembly each include a receiving aperture. The outwardly extending coupling feature of the first sidewall of the door is removeably received in the receiving aperture of the first outer sidewall of the storage bin assembly. The outwardly extending coupling feature of the second sidewall of the door is removeably received in the receiving aperture of the second outer sidewall of the storage bin assembly.

These and other features, advantages, and objects of the present device will be further understood and appreciated by those skilled in the art upon studying the following specification, claims, and appended drawings.

DETAILED DESCRIPTION OF EMBODIMENTS

Figure 1:
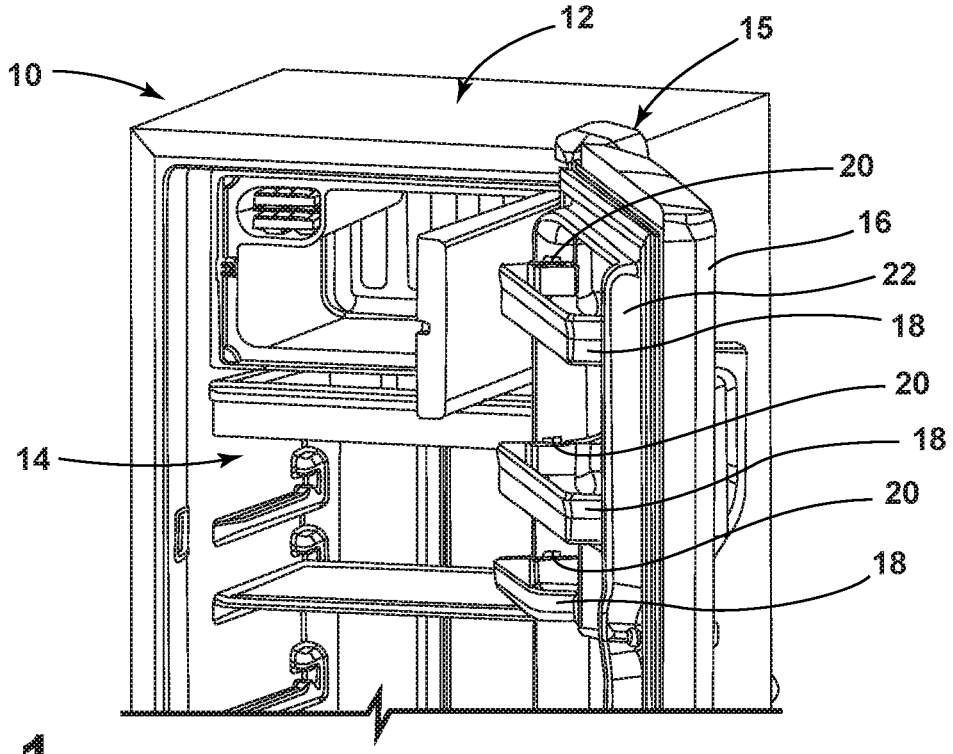
FIG. 1 is a top perspective view of a refrigerator.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring now to FIG. 1, a refrigerator 10 is shown having a cabinet 12 with a refrigerated compartment 14. The refrigerated compartment 14 is selectively accessible via a door 16 that is pivotally coupled to the cabinet 12 at a hinge 15. The door 16 includes a plurality of storage bin assemblies 18 coupled to coupling features 20 disposed on opposing sidewalls of a door liner 22.

Figure 2:
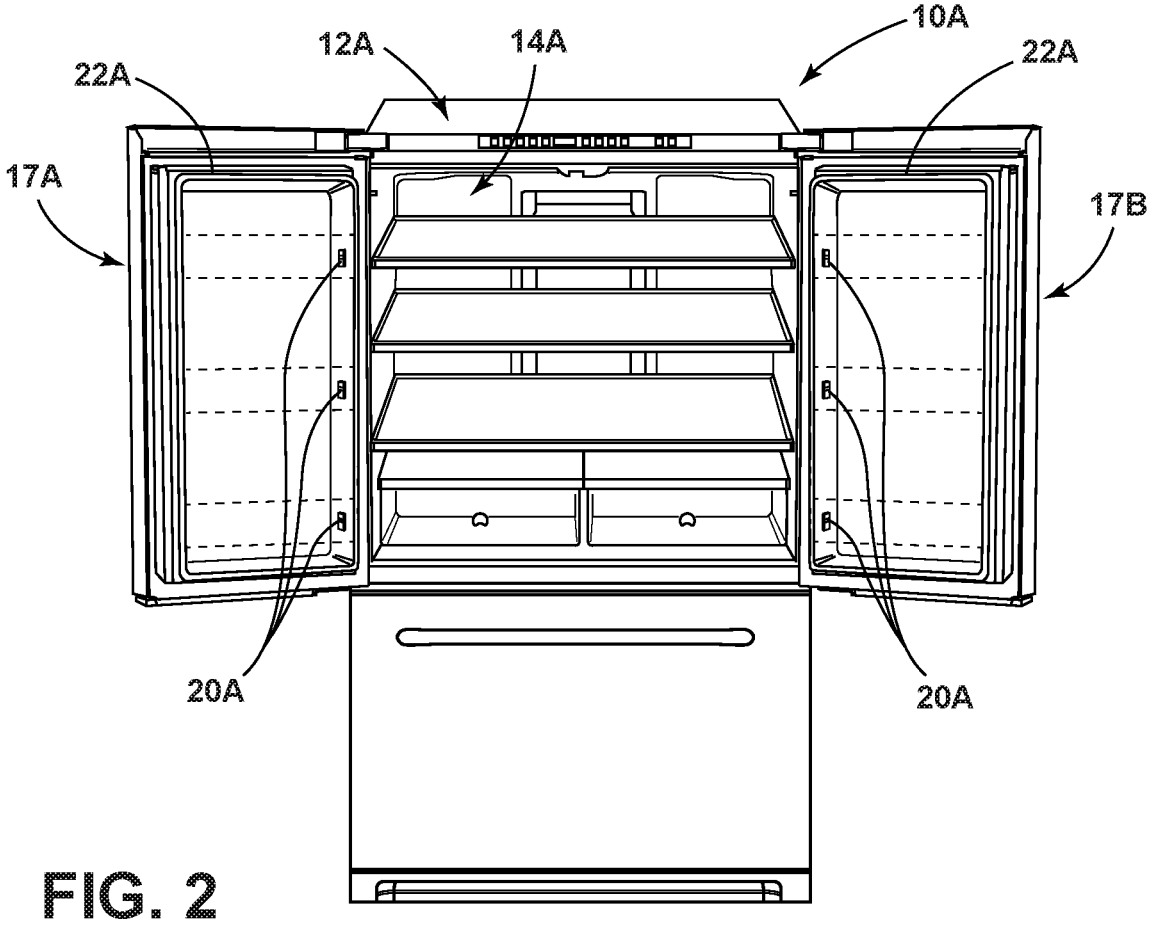
FIG. 2 is a front perspective view of a refrigerator.

Referring now to FIG. 2, another embodiment of a refrigerator 10A is shown having a cabinet 12A with a refrigerated compartment 14A. The refrigerated compartment 14A is selectively accessible via doors 17A and 17B that are pivotally coupled to the cabinet 12A. The doors 17A, 17B include a plurality of coupling features 20A that outwardly extend from opposing sidewalls of door liners 22A disposed on doors 17A and 17B. Various vertical positions for storage bin assemblies supported from the doors 17A, 17B are identified in FIG. 2 in dashed lines disposed along the liners 22A of the doors 17A, 17B.

The refrigerators 10 and 10A (FIGS. 1 and 2) are different embodiments of a refrigerator having doors that can be used with the storage bin assembly of the present concept. It is noted that the storage bin assembly of the present concept can be used with other refrigerator configurations beyond those shown in FIGS. 1 and 2. As further described herein, the storage bin assembly of the present concept is configured to couple to a door of a refrigerator and be removeably supported therefrom for easy access by a user.

Figure 3:
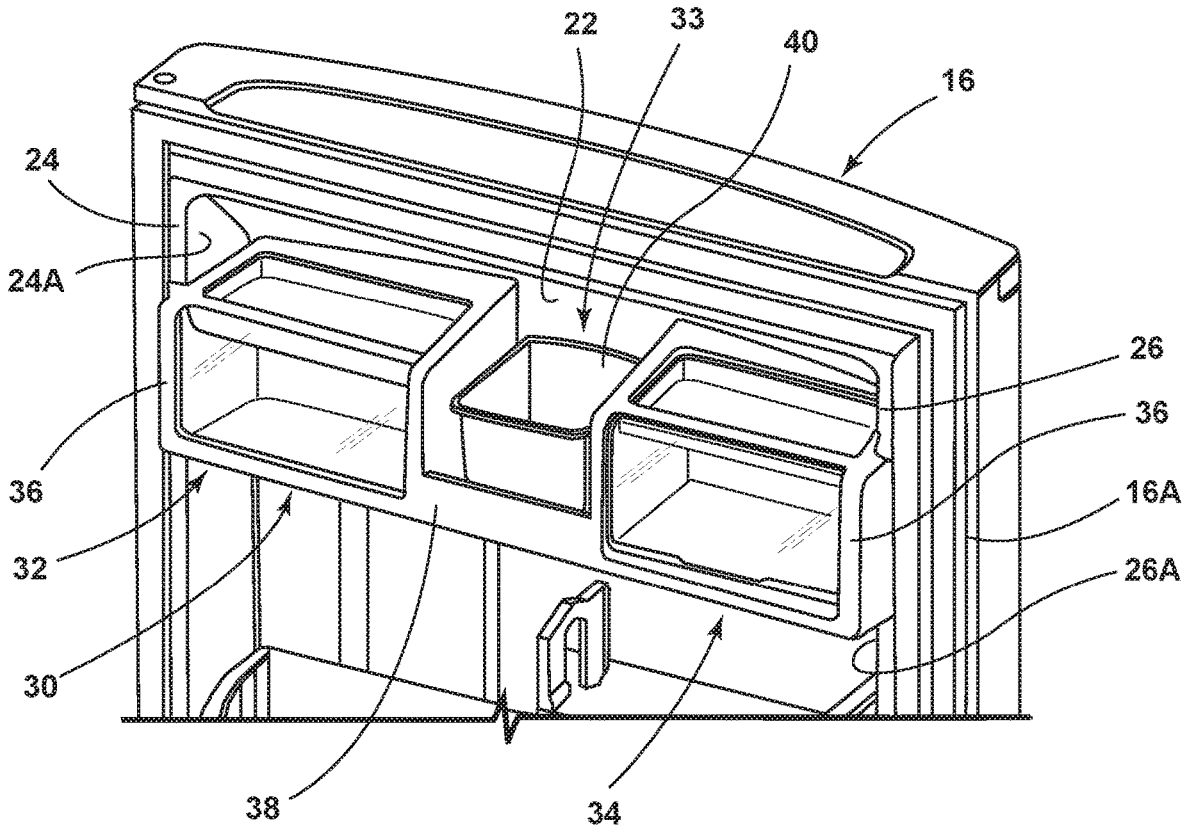
FIG. 3 is a top perspective view of a refrigerator door having a storage bin assembly coupled thereto.

Referring now to FIG. 3, a refrigerator door 16 is shown having a storage bin assembly 30 coupled thereto. Specifically, the storage bin assembly 30 is coupled to a liner 22 positioned on an inner surface 16A of the door 16. The liner 22 of the door 16 includes outwardly extending sidewalls 24, 26 which each include inner surfaces 24A and 26A, respectively, that face one another in an opposed manner. As shown in FIG. 3, the storage bin assembly 30 is coupled to the inner surfaces 24A, 26A of the liner 22, and is contemplated to be removeably coupled thereto. In the embodiment shown in FIG. 3, the storage bin assembly 30 includes first and second compartments 32, 34 which include a number of similar features that will be described herein using like reference numerals. In FIG. 3, the first and second compartments 32, 34 are of a similar size and are reversed mirror images of one another, however, it is contemplated that the compartments 32, 34 may vary in size from one another. As specifically shown in FIG. 3, the first and second compartments 32, 34 each include a frame assembly 36 upwardly extending from a base portion 38 of the storage bin assembly 30. The frame assemblies 36 of the first and second compartments 32, 34 are spaced-apart from one another to define an open central bin 33 disposed between the first and second compartments 32, 34. In the embodiment shown in FIG. 3, the open bin 33 includes a removable storage container 40 that is set in-place and supported in an upright position on the base portion 38 of the storage bin assembly 30 within the open bin 33. With the open bin 33 having no cover member, stored items are readily retrieved from the open bin 33 or the storage container 40 by a user. As further shown in FIG. 3, the first and second compartments 32, 34 are selectively closed compartments, as further described below. While the storage bin assembly 30 of FIG. 3 includes first and second compartments 32, 34, and an open central bin 33, it is contemplated that the storage bin assembly 30 may include any bin configuration, and is not limited to the configuration shown in the accompanying figures.

Figure 4A:
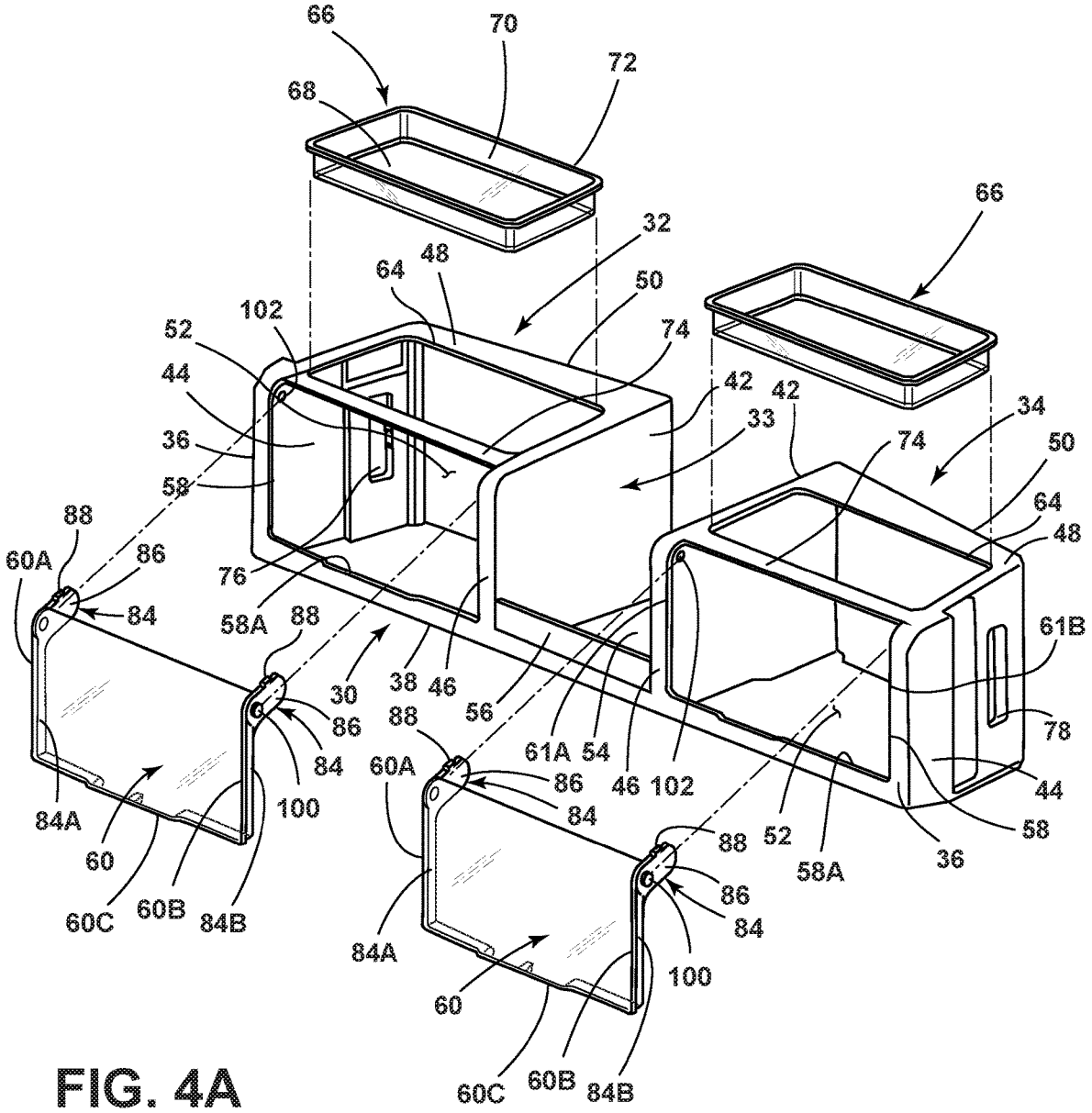
FIG. 4A is a top perspective view of the storage bin assembly of FIG. 3 as removed from the refrigerator door with doors and insert trays exploded away therefrom.

Referring now to FIG. 4A, the frame assemblies 36 of the first and second compartments 32, 34 each include inner and outer sidewalls 42, 44, as well as front walls 46, top walls 48, and rear walls 50. Together, the inner and outer sidewalls 42, 44, front walls 46, top walls 48, and rear walls 50 cooperate with the base portion 38 to define interior cavities 52 of the first and second compartments 32, 34. The inner sidewalls 42 of the first and second compartments 32, 34 are spaced-apart from one another to generally defined the parameters of the open storage bin 33 disposed between the first and second compartments 32, 34. As shown in FIG. 4A, a support surface 54 spans the distance between the inner sidewalls 42 of the first and second compartments 32, 34, and an upwardly extending retaining lip 56 is disposed along a front portion of the open storage bin 33 to retain items stored therein. The front walls 46 of the frame assemblies 36 include front apertures 58 which selectively provide access to the inner cavities 52 of the first and second compartments 32, 34 via doors 60. The front apertures 58 are shown in FIG. 4A as extending from the front walls 46 to the top walls 48 and are substantially positioned between the inner and outer sidewalls 42, 44 of the frame assemblies 36 of the first and second compartments 32, 34.

Figure 4B:
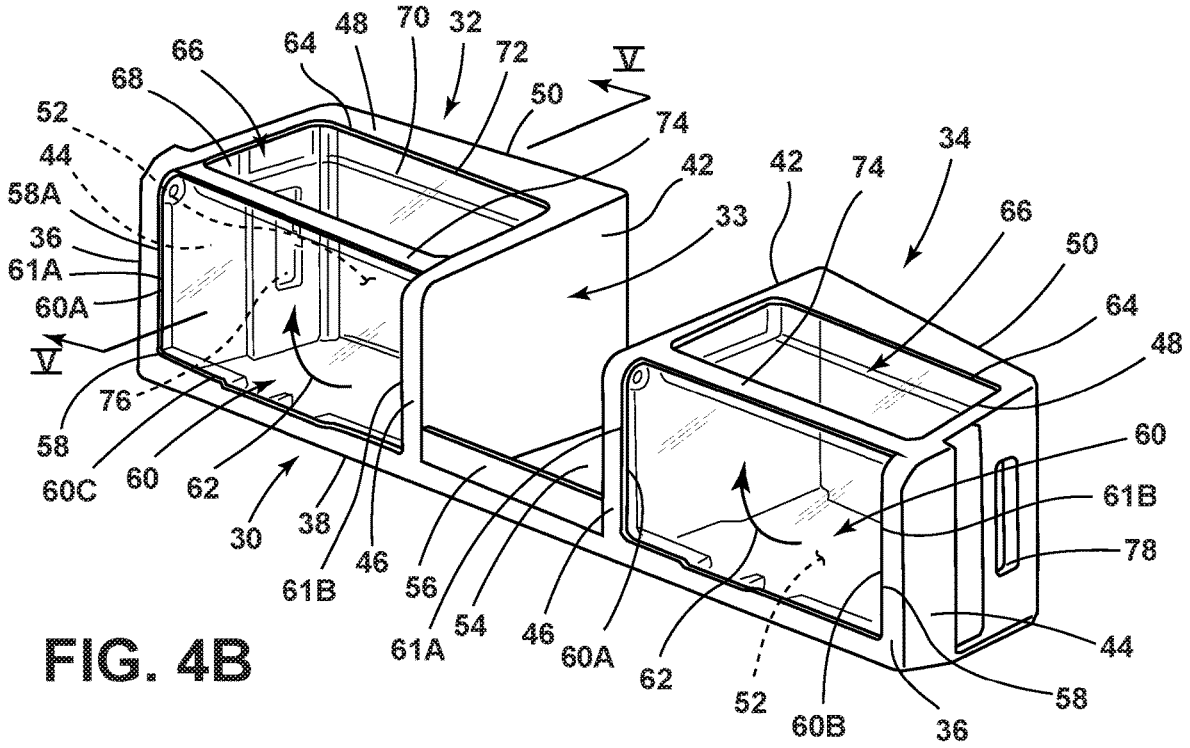
FIG. 4B is a top perspective view of the storage bin assembly of FIG. 4A as assembled.

Referring now to FIG. 4B, the doors 60 are shown received in the front apertures 58 and are configured to be pivotally coupled to the inner and outer sidewalls 42, 44, such that the doors 60 can pivot in the direction as indicated by arrows 62 between open and closed positions 4. In the embodiment shown in FIG. 4B, the doors 60 are in the closed position to close off the inner cavities 52 of the first and second compartments 32, 34.

With further reference to FIG. 4A, the top walls 48 of the frame assemblies 36 of the first and second compartments 32, 34 include upper apertures 64 having insert tray members 66 exploded away therefrom. Each insert tray member 66 includes a support surface 68 and a surrounding perimeter wall 70 that upwardly extends from the support surface 68, such that the support surface 68 is an inset support surface, wherein items can be stored thereon. It is contemplated that the insert tray members 66 can be set in-place in an abutting position on the upper apertures 64 of the frame assemblies 36 by an outwardly extending rim portion 72 abutting the top wall 48 of the frame assemblies 36 of the associated compartment 32, 34. Further, it is contemplated that the insert tray members 66 can be configured in an under-mount configuration relative to upper apertures 64 as further described below. The insert tray members 66 can be fixed in place and adhered to the upper apertures 64 to define an upper wall of the inner cavities 52 of the first and second storage compartments 32, 34. It is contemplated that the insert tray members 66 can be removable when top-mounted to the upper apertures 64 in an abutting relationship. In FIG. 4B, the insert tray members 66 are shown under-mounted to the upper apertures 64 of the first and second storage compartments 32, 34.

With further reference to FIGS. 4A and 4B, the doors 60 and the insert tray members 66 are contemplated to be comprised of a substantially translucent material, such that a user can view items stored in the inner cavities 52 of the first and second storage compartments 32, 34 through the front portions of the storage compartments 32, 34, through the translucent doors 60, and further view the contents of the inner cavities 52 of the first and second storage compartments 32, 34 through the top portions of the storage compartments 32, 34, through the translucent insert tray members 66. In this way, the first and second compartments 32, 34 of the storage bin assembly 30 provide for improved visibility given the translucent door and tray features which make the inner cavities 52 of the first and second storage compartments 32, 34 accessible to ambient light to further increase visibility within the inner cavities. Further, the translucent features of the first and second storage compartments 32, 34 are distinguished from the remaining components of the first and second storage compartments 32, 34 as the frame assemblies 36 are contemplated to be comprised of opaque materials. Suitable materials for the frame assemblies 36, the doors 60, and the insert tray members 66 are polymeric materials that may be formed using an injection molding technique. As used herein, the term "substantially translucent material" refers to a material that a user can see through and also a material that transmits light therethrough.

As further shown in FIG. 4A, the door 60 includes opposite sides 60A, 60B. With reference to FIG. 4B, when the door 60 is installed on storage compartment 34, the opposite sides 60A, 60B of the door 60 are spaced-apart from inner surfaces 44A (FIGS. 5-7) of the inner and outer sidewalls 42, 44 to form vertical gaps 61A, 61B therebetween. In this way, from an outer perspective, the door 60 does not contact the inner and outer sidewalls 42, 44 when the door 60 is in the closed position beyond pivoting coupling points and an abutting stop feature contact point disposed within the inner cavities 52, as further described below with specific reference to FIG. 6. It is contemplated that equal spacing is provided for a perimeter 60C of the doors 60 with a perimeter 58A of the front apertures 58 of the frame assemblies 36.

With further reference to FIGS. 4A and 4B, a support member 74 of the frame assemblies 36 spans between the inner and outer sidewalls 42, 44 of the first and second storage compartments 32, 34 between the front apertures 58 and the upper apertures 64. The support members 74 define an abutment member at an inner surface 90 (FIG. 6) thereof for the doors 60 when the doors 60 are in the closed position, as further described below. As further shown in FIG. 4A, the outer sidewalls 44 define outermost sidewalls of the storage bin assembly 30 and include first and second receiving apertures 76 and 78 disposed therethrough. The receiving apertures 76, 78 are shown in FIG. 4A as being disposed fully through the outer sidewalls 44 of the storage bin assembly 30, however, it is also contemplated that the receiving apertures 76, 78 may be inset portions of the outer sidewalls 44 that do not open into the inner cavities 52 of the first and second storage compartments 32, 34. In assembly, the receiving apertures 76, 78 are used to couple to the coupling features of a refrigerator liner, such as coupling features 20, 20A shown disposed on and extending outwardly from the liners 22 and 22A, respectively, in FIGS. 1 and 2. The coupling of the storage bin assembly 30 to a refrigerator liner is further described below with specific reference to FIGS. 8 and 9.

With further reference to FIG. 4A, the doors 60 each include first and second retaining struts 84A, 84B disposed near the opposite sides 60A, 60B, respectively. Each retaining strut 84A, 84B includes an attachment post 100 that is outwardly extends therefrom to be received in respective mounting apertures 102 disposed on both the inner and outer sidewalls 42, 44 of the frame assemblies 36 of the storage compartments 32, 34. In this way, the doors 60 are pivotally mounted to their respective front apertures 58 of the frame assemblies 36.

Figure 5:
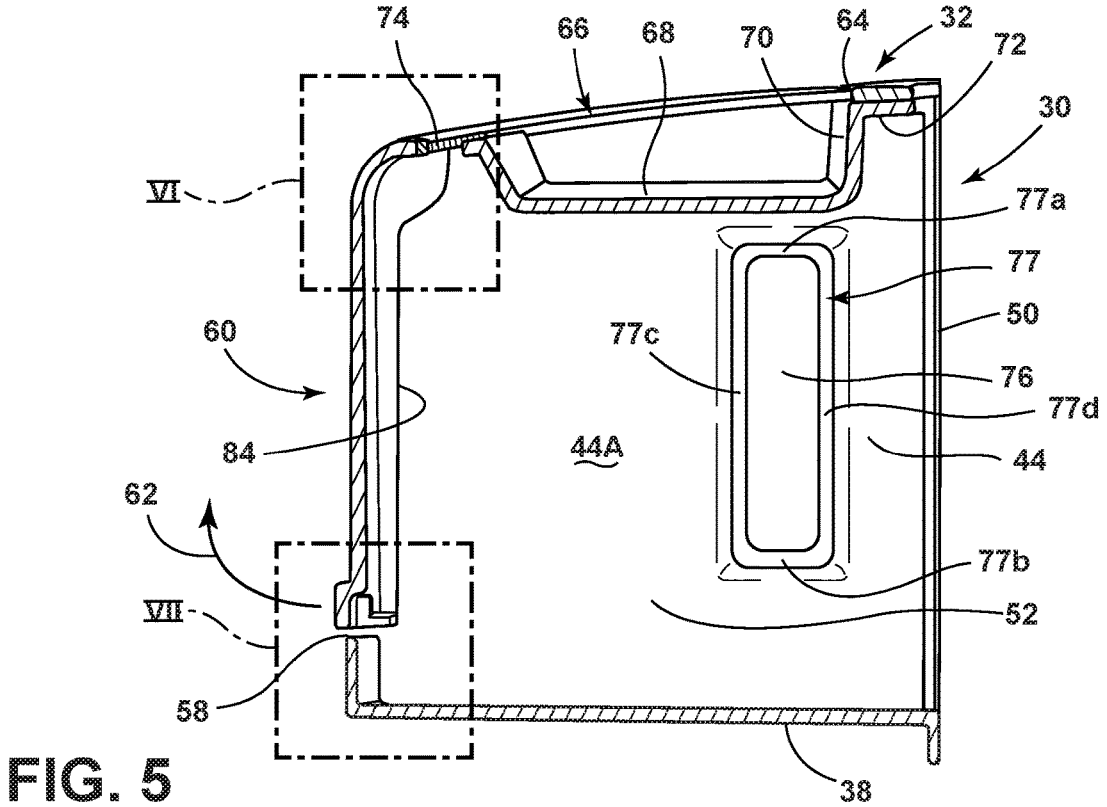
FIG. 5 is a cross-sectional view of the storage bin assembly of FIG. 4B taken at line V.
Figure 9:
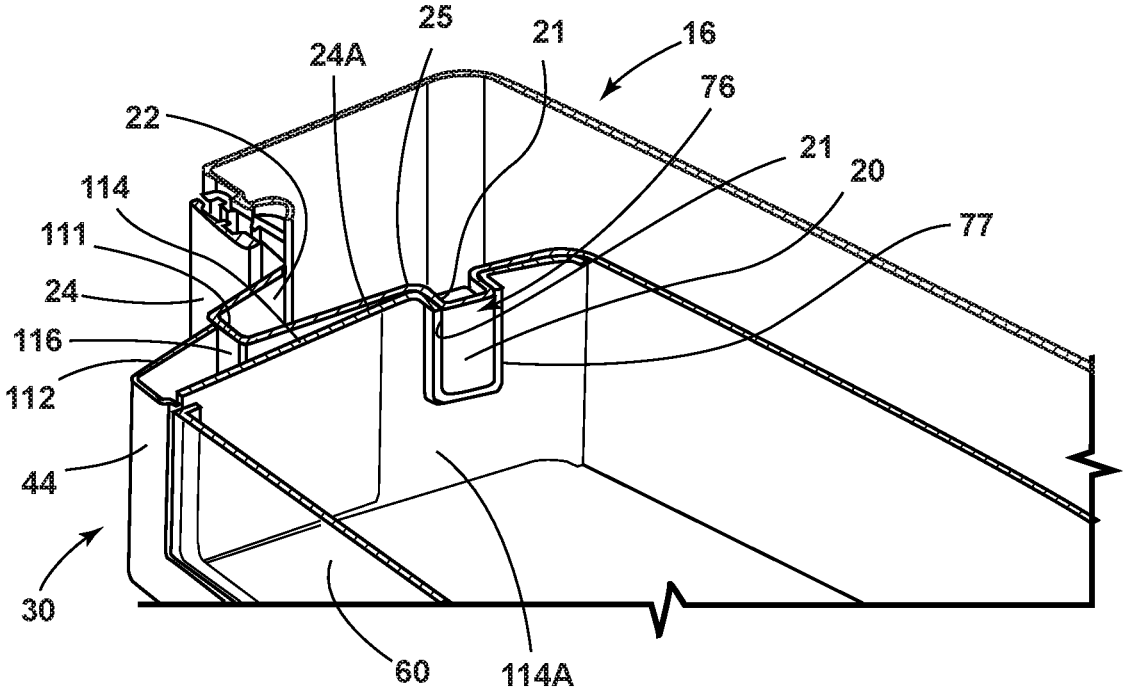
FIG. 9 is a cross-sectional view of the storage bin assembly of FIG. 8 taken at line IX.

Referring now to FIG. 5, the storage bin assembly 30 is shown from a cross-sectional view through the first storage compartment 32 of FIG. 4B. In FIG. 5, the door 60 is shown in the closed position relative to the front aperture 58 of the first storage compartment 32. In the closed position, the door 60 closes off the interior cavity 52 of the first storage compartment 32 to separate items stored therein. Receiving aperture 76 is shown disposed on outer sidewall 44 and includes a rim portion 77 inwardly extending into the inner cavity 52 of the first storage compartment 32. As shown in FIG. 5, the rim portion 77 of the receiving aperture 76 includes upper and lower surfaces 77*a*, 77*b* interconnected by first and second side surfaces 77*c*, 77*d*. The upper and lower surfaces 77*a*, 77*b* are parallel to one another and the first and second side surfaces 77*c*, 77*d* are also parallel to one another to form a generally rectangular shape for the receiving aperture 76. In this way, a four-way retention feature is achieved as a substantially rectangular-shaped coupling feature can be sized to be closely received in the receiving aperture 76 having four associated surfaces to interface with the upper and lower surfaces 77*a*, 77*b* and first and second side surfaces 77*c*, 77*d* of the receiving aperture 76 in assembly. This arrangement is best shown in FIG. 9. The operation of the door 60 will now be described, and it is contemplated that the operation, description and features of the door 60 described with reference to FIGS. 5-7 are also applicable to the operation and function of the door 60 disposed on the second storage compartment 34.

Figure 6:
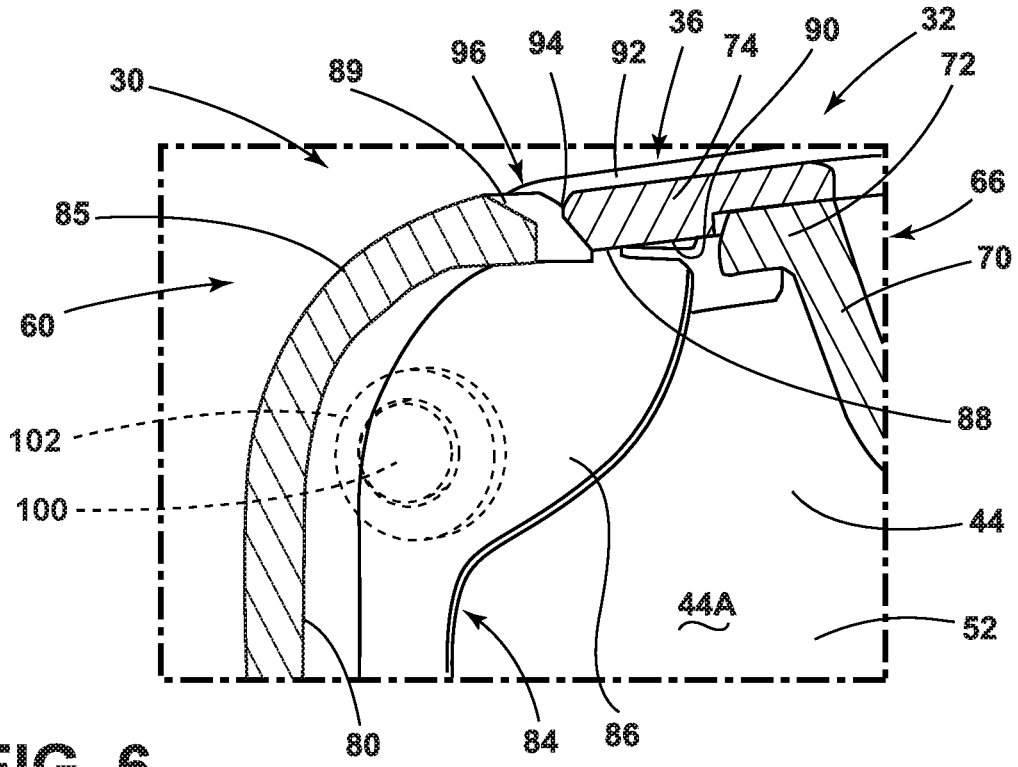
FIG. 6 is a side elevational view of the storage bin assembly of FIG. 5 taken at location VI.
Figure 7:
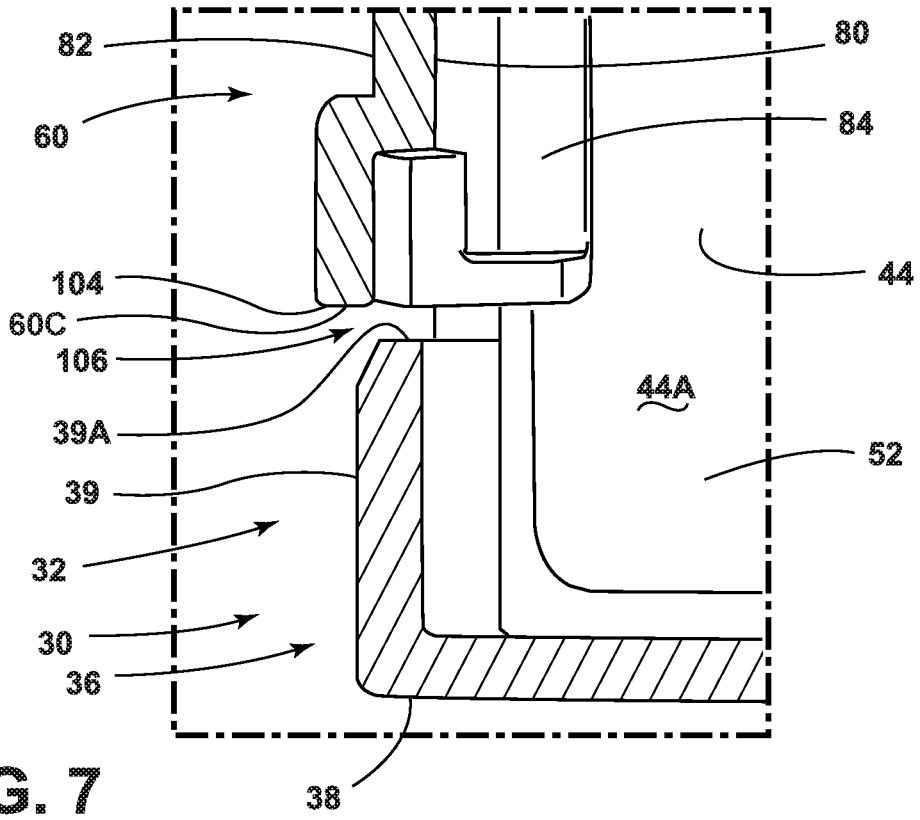
FIG. 7 is a side elevational view of the storage bin assembly of FIG. 5 taken at location VII.

Referring now to FIG. 6, the door 60 is shown having inner and outer surfaces 80, 82 with an upper curved portion 85 having an upper end 89. From the inner surface 80 of the door 60, a retaining strut 84 inwardly extends into the inner cavity 52 of the first storage compartment 32. Retaining strut 84 is exemplary of the first and second retaining struts 84A, 84B shown disposed on the door 60 in FIG. 4A. A flange member 86 inwardly extends from the retaining strut 84 at an upper portion of the retaining strut 84. As shown in FIG. 6, the flange member 86 extends inwardly into the inner cavity 52 of the first storage compartment 32 beyond the upper end 89 of the door 60. The flange member 86 further includes an upwardly extending tab 88 which is configured to contact the support member 74 of the first storage compartment 32 when the door 60 is in the closed position. As shown in FIG. 6, the support member 74 includes inner and outer surfaces 90, 92 and a front end 94. The front end 94 of the support member 74 is spaced-apart from the upper end 89 of the door 60 to provide a spacing or gap 96 therebetween. With the upper horizontal gap 96 disposed between the upper end 89 of the door 60 and the front end 94 of the support member 74, there is no contact between the door 60 and the frame assembly 36 of the first storage compartment 32 outside of contact points disposed within the interior cavity 52 of the first storage compartment 32. Having contact points disposed only within the interior cavity 52 of the first storage compartment 32, ambient noise reduction is realized in the operation of the door 60 between open and closed positions.

Another point of contact between the door 60 and the frame assembly 36 within the interior cavity 52 is located at the pivoting coupling interface between the door 60 and the sidewall 44. On an outer surface of the flange member 86 of the retaining strut 84, the attachment post 100 (also shown in FIG. 4A) outwardly extends and is pivotally received in the mounting aperture 102 disposed on an inner surface 44A of the outer sidewall 44. The attachment post 100 extends laterally outward from the retaining strut 84 to be received in the mounting aperture 102 disposed on the inner surface 44A of the outer sidewall 44. A similar configuration is contemplated for a second retaining strut disposed on an opposite side of the inner surface 80 of the door 60 relative to the retaining strut 84 shown in FIG. 6 to pivotally couple to a mounting boss disposed on the inner sidewall 42 of the storage compartment 32, as shown in FIG. 4A. In this way, the door 60 is pivotally coupled to the frame assembly 36 at inner and outer sidewalls 42, 44 of the frame assembly 36 between open and closed positions. Thus, retaining struts, such as retaining strut 84 described above, are contemplated to be disposed on the opposite sides 60A, 60B (FIG. 4A) of the door 60 along the inner surface 80 thereof for pivotally coupling the door 60 to the sidewalls 42, 44 of the storage compartment 32.

With further reference to FIG. 6, flange member 86 of the retaining strut 84 rotates upward as the door 60 moves from the open position to the closed position until the upwardly extending tab 88 contacts, in an abutting manner, the underside or inner surface 90 of the support member 74. In this way, the support member 74 acts as a stop feature located within the inner cavity 52 for the rotation of the door 60 when the door 60 is fully closed in the closed position. Thus, the abutment of the upwardly extending tab 88 of the flange member 86 and the inner surface 90 of the support member 74 prevents over-rotation of the door 60 and ensures that the door 60 stops a closing motion thereof at a proper location for providing consistent spacing of the perimeter 60C of the door 60 with the perimeter 58A of the front aperture 58 in a consistent and repeatable manner. It is contemplated that the abutment of the upwardly extending tab 88 of the flange member 86 of the retaining strut 84 may occur at any interior surface of the inner cavity 52 and is not limited to the inner surface 90 of the support member 74. With the abutment of the retaining strut 84 on an interior surface of the inner cavity 52, the door 60 is closed in a proper position wherein the perimeter of the door 60C is evenly spaced-apart from the perimeter 58A of the front aperture 58 along all sides of the perimeter 60C of the door 60.

Referring now to FIG. 7, the door 60 is shown having a lower end 104 that is part of the perimeter 60C of the door 60 and is vertically spaced-apart from the lip portion 39 that upwardly extends from the base portion 38 to define a gap 106 between the door 60 and the base portion 38 when the door 60 is in the closed position. The gap 106, much like gaps 61A, 61B and 96, is a consistent spacing between the door 60 and the frame assembly 36 as the flange member 86 of the retaining strut 84 acts as a hard stop to terminate closing rotation or pivoting movement of the door 60 at a consistent stopping point by abutting the underside 90 of the support member 74 at the upwardly extending tab 88. Thus, with the lower end 104 of the door 60 spaced away from an upper end 39A of the lip 39 of the base portion 38, the door 60 again does not contact the frame assembly 36 outside of the pivoting contacts and the abutting stop feature contact disposed within the inner cavity 52 of the first storage compartment 32. Thus, the door 60 is spaced-apart from the base portion at gap 106, spaced-apart from the support member 74 at gap 96, and further spaced-apart from the first and second sidewalls 42, 44 at the opposite sides 60A, 60B of the door 60 (FIG. 4B) at gaps 61A, 61B. In this way, the door 60 has vertical gaps 61A, 61B (at the opposite sides 60A, 60B of the door 60 (FIG. 4B)) and horizontal gaps 96, 106 to completely surround the perimeter 60C of the door 60 with visible spacing between the door 60 and the perimeter 58A of the front opening 58 of the frame assembly 36.

Figure 8:
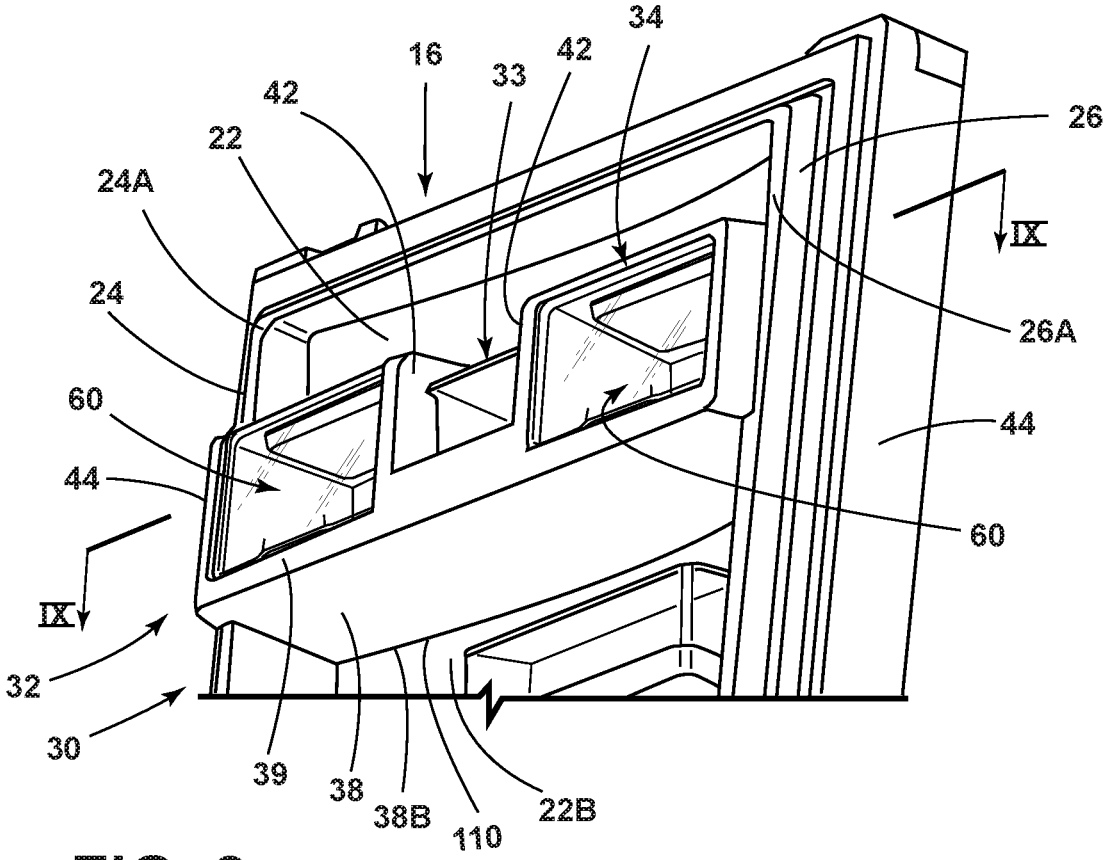
FIG. 8 is a bottom perspective view of the refrigerator door and storage bin assembly of FIG. 3.

Referring now to FIG. 8, the refrigerator door 16 is shown from a bottom perspective view with the storage bin assembly 30 coupled thereto. The base portion 38 of the storage bin assembly 30 is shown having a contoured inner edge 110 along a rear side 39B thereof that follows a contoured outer surface 22B of the liner 22 to which the storage bin assembly 30 is coupled. As noted above, liner 22 of the door 16 includes outwardly extending sidewalls 24, 26 which each include inner surfaces 24A and 26A, respectively, which face one another. As shown in FIG. 8, the storage bin assembly 30 is coupled to the inner surfaces 24A, 26A of the liner 22, and is contemplated to be removeably coupled thereto as best described below with reference to FIG. 9.

Referring now to FIG. 9, a cross-sectional view of the storage bin assembly 30 is shown as coupled to the liner 22 of the refrigerator door 16. The liner 22 includes outwardly extending sidewall 24 having a distal end portion 111. It is contemplated that the liner 22 includes a similar configuration to that shown in FIG. 9 at outwardly extending sidewall 26 disposed on an opposite end of the refrigerator door 16. The outer sidewall 44 of the storage bin assembly 30 includes a front portion 112 that outwardly extends relative to a rear portion 114, having a shoulder portion 116 disposed therebetween. In assembly, the shoulder portion 116 of the outer sidewall 44 of the storage bin assembly 30 abuts the distal end 111 of the sidewall 24 of the liner 22 when the storage bin assembly 30 is coupled to the liner 22. The abutting contact between the outer sidewall 44 of the storage bin assembly 30 and the outwardly extending sidewall 24 of the liner 22 provides for a first retaining feature in a first direction at the abutment of shoulder portion 116 of outer sidewall 44 and distal end 111 of outwardly extending sidewall 24 of the liner 22. Further, abutting contact between the rear portion 114 of the outer sidewall 44 of the storage bin assembly 30 and the inner surface 24A of the outwardly extending sidewall 24 of the liner 22 provides for a second retaining feature in a second direction that is substantially perpendicular to the first direction of the first retaining feature. Further, as noted above, the storage bin assembly 30 is configured to be removeably coupled to the liner 22. Part of this removable coupling occurs at the connection between the liner 22 and the storage bin assembly 30 at coupling feature 20 which outwardly extends from the inner surface 24A of the sidewall 24 of the liner 22. As noted above, the outer sidewalls 44 of the storage bin assembly 30 include receiving apertures 76, 78, as shown in FIG. 4A. In the embodiment shown in FIG. 9, receiving aperture 76 is shown having an inwardly extending rim portion 77 disposed around a perimeter thereof. The outwardly extending coupling feature 20 of the liner 22 is shown in FIG. 9 in the form of a rectangular coupling block received in the receiving aperture 76, which is also rectangular. In this way, the sidewalls 21*b*-21*d* of the coupling block 20 are in contact with the surfaces or sidewalls 77*b*-77*d* of the rim portion 77 of the receiving aperture 76 to thereby create a third retaining feature in multiple directions around the sidewall 21 of the coupling block 20. While not shown in FIG. 9, an upper sidewall of the coupling block 20 is contemplated to engage the upper surface 77*a* (FIG. 5) of the rim portion 77 of receiving aperture 76 to fully surround the coupling block 20 with engaging connections.

As further noted in FIG. 9, the receiving aperture 76 is disposed on an inwardly angled portion 114A of the outer sidewall 44. The inwardly angled portion 114A of the outer sidewall 44 abuts an inwardly angled portion 25 of the inner surface 24A of sidewall 24 of the liner 22. It is from the inwardly angled portion 25 of the sidewall 24 of the liner 22 that the coupling feature 20 outwardly extends. Thus, when inserting the storage bin assembly 30 into the door 16, the inwardly angled portion 114A of outer sidewall 44 of the storage bin assembly 30 can fit against the inwardly angled portion 25 of the sidewall 24 of the liner 22 as an introductory ramp leading towards the coupling feature 20. Thus, the sidewall 44 is contemplated to be somewhat flexibly resilient to receive the coupling feature 20 in the receiving aperture 76 in a snap-fit engagement.

With the coupling of the storage bin assembly 30 to the liner 22 of the refrigerator door 16 in the manner described above having multiple retain features in multiple directions, there is no need to further retain the storage bin assembly 30 to the liner 22 during transport of the refrigerator, as this coupling arrangement includes a multidirectional retaining feature as described above. Where other concepts may require some type of secondary engagement (such as taping a storage bin to a liner), the storage bin assembly 30 of the present concept does not require such secondary engagement once the storage bin assembly 30 is coupled to the liner 22 in a manner as described with reference to FIGS. 8 and 9.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A storage compartment for a refrigerator, comprising:

first and second sidewalls upwardly extending from a base portion and spaced-apart from one another to define an inner cavity therebetween;

a support member interconnecting the first and second sidewalls; and a door pivotally coupled along an upper portion thereof to the first and second sidewalls between open and closed positions, wherein the door further includes one or more inwardly extending retaining struts disposed at the upper portion thereof, and further wherein the one or more inwardly extending retaining struts rotate upwardly within the inner cavity, such that an upper surface of the one or more inwardly extending retaining struts abuts an undersurface of the support member when the door is moved from the open position to the closed position.

2. The storage compartment of claim 1, wherein the door includes a lower end that is spaced-apart from the base portion when the door is in the closed position.

3. The storage compartment of claim 1, including:

first and second mounting apertures disposed on inwardly facing surfaces of the first and second sidewalls respectively.

4. The storage compartment of claim 3, wherein the one or more inwardly extending retaining struts define first and second inwardly extending retaining struts disposed on opposite sides of an inner surface of the door, and first and second outwardly extending attachment posts disposed on the first and second inwardly extending retaining struts, respectively, wherein the first and second outwardly extending attachment posts are received in the first and second mounting apertures of the first and second sidewalls, respectively, to pivotally couple the door to the first and second sidewalls.

5. The storage compartment of claim 1, wherein the door is comprised of a substantially translucent material.

6. The storage compartment of claim 5, including:

a top wall interconnecting the first and second sidewalls and having an upper aperture disposed therethrough; and an insert tray member disposed on the upper aperture.

7. The storage compartment of claim 6, wherein the insert tray member is comprised of a substantially translucent material, such that the inner cavity is visible through both the door and the insert tray member.

8. The storage compartment of claim 1, wherein the door is coupled to portions of the first and second sidewalls within the inner cavity.

9. A storage compartment for a refrigerator, comprising:

a frame assembly defining an inner cavity and having a front aperture opening into the inner cavity and a support member disposed above the front aperture; and a door pivotally coupled to the frame assembly at pivot locations disposed within the inner cavity, wherein the door further includes a retaining strut disposed on an inner surface of the door that inwardly extends into the inner cavity and having an upper surface that rotates upwardly to abut an underside of the support member of the frame assembly within the inner cavity when the door is moved downwardly from an open position to a closed position.

10. The storage compartment of claim 9, wherein the front aperture includes a perimeter and the door includes a perimeter, and further wherein the perimeter of the door is evenly spaced-apart from the perimeter of the front aperture on all sides of the perimeter of the door.

11. The storage compartment of claim 9, wherein the retaining strut includes an inwardly extending flange member having an upwardly extending tab.

12. The storage compartment of claim 9, including:

an upper aperture disposed on the frame assembly above the front aperture, wherein the upper aperture opens into the inner cavity; and a tray member mounted at the upper aperture, wherein both the door and the tray member are comprised of a substantially translucent material.

* * * * *